US006917018B1

(12) United States Patent
Wong

(10) Patent No.: US 6,917,018 B1
(45) Date of Patent: Jul. 12, 2005

(54) ELECTRIC OVEN WITH RECONFIGURABLE HEATING ELEMENTS

(75) Inventor: John Ying Man Wong, Shatin (HK)

(73) Assignee: Raymond Electric (China) Ltd., Shatin (HK)

( * ) Notice: Subject to any disclaimer, the term of this patent is extended or adjusted under 35 U.S.C. 154(b) by 281 days.

(21) Appl. No.: 10/301,623

(22) Filed: Nov. 22, 2002

(51) Int. Cl.[7] ..... B23K 9/67
(52) U.S. Cl. ..... 219/404; 219/411; 99/421 V
(58) Field of Search ..... 219/395–398, 219/404, 411; 99/419, 421 R, 421 V

(56) References Cited

U.S. PATENT DOCUMENTS 2,558,294 A * 6/1951 Finzie ..... 99/421 R
2,848,592 A * 8/1958 Mergen ..... 219/404
2,984,730 A * 5/1961 Ostrom ..... 219/395
3,522,414 A * 8/1970 Kramer ..... 219/395
5,548,102 A * 8/1996 Kwon ..... 219/404
5,575,196 A * 11/1996 Masel et al. ..... 99/421 V
5,747,781 A * 5/1998 Kim et al. ..... 219/404
5,907,994 A * 6/1999 Dotan ..... 99/421 V
6,184,499 B1 * 2/2001 Antoine ..... 219/404
6,199,473 B1 * 3/2001 Dotan et al. ..... 99/421 V

* cited by examiner

*Primary Examiner*—Joseph Pelham
(74) *Attorney, Agent, or Firm*—Leydig, Voit & Mayer, Ltd.

(57) ABSTRACT

A food processing apparatus including a main housing, a heating compartment, first heating means and second heating means, the heating compartment being enclosed within the main housing, the first heating means being generally disposed proximal to the peripheral surface of the heating compartment for generating heat across the heating compartment for heating food or food items placed within the heating compartment, the second heating means generally extend from a peripheral surface of the heating compartment towards the inside of the heating compartment for generating heat towards the peripheral surfaces of the heating compartment.

17 Claims, 4 Drawing Sheets

ELECTRIC OVEN WITH RECONFIGURABLE HEATING ELEMENTS

FIELD OF THE INVENTION

The present invention relates to food processing apparatus and, more particularly, to food processing apparatus with electric heating means. Yet more particularly, this invention relates to food processing apparatus with reconfigurable heating means. More specifically, although of course not solely limiting thereto, this invention relates to electric ovens with heating means adapted for cooking both chunky and non-chunky food items.

BACKGROUND OF THE INVENTION

Food processing apparatus with a cooking or heating compartment heated with electrical compartments are commonly referred to as electric ovens and have been widely used for a long time. A conventional electric oven generally includes a substantially rectangular cooking compartment with a hinged door to provide access to the cooking compartments. Distributed heating elements, including convection and radiant heating elements, such as resistive or infra-red heating elements, are usually disposed near the periphery of the cooking compartment to provide maximum cooking food processing space.

Usually, the heating elements are arranged into a multiple-U shape so that a more even heating can be achieved across the cooking compartment. In operation, the heat generated by the distributed heating elements is generally transmitted across the cooking compartment so that the food item or items placed inside the cooking compartment can be processed by convection or radiant heating. Conventional electric ovens in the present context also include toasters or toasting apparatus in which the food item to be toasted is placed between two sets of distributed heating elements so that at least two sides of the food item can be subject to convection or radiant heating by the heating elements. Typically, an electric oven is commonly referred to as a toasting apparatus or a toaster when the heating elements are placed more proximal to the surfaces of the food item to be heated.

Conventional ovens of the type described above generally suffer from major shortcomings when bulky, chunky or voluminous food items or articles such as a whole chicken or a pork leg are concerned. When processing such food items, a conventional electric oven is usually set to operate in a relatively low temperature for an extended period of time so that heat can gradually and slowly penetrate into the inside of the food item to avoid burning their surfaces. However, the requirement of a lengthy processing time is generally not desirable for modern day living. In addition, it is appreciated that moisture will tend to be lost during a slow oven cooking process and the food cooked is likely to be less succulent than otherwise possible. Although microwave ovens are known for its ability to cook bulky food items within a relatively short period of time, microwave oven cooked food items are seldom complimented by the more discerning food consumers, and even less by connoisseurs.

Hence, there is a long existing need for electric ovens with enhanced capability for processing bulkier or chunkier food items. In fulfilling this need, it will be highly beneficial if such improved electric ovens can process thicker food items in lesser time while retaining the desirable characteristics of food cooked by conventional electric ovens, such as a golden, crispy or crunchy exterior. Preferably, such improved electrical ovens can be configurable between a baking oven and a toaster for additional flexibility.

OBJECT OF THE INVENTION

Broadly speaking, it is an object of the present invention to provide electric ovens with improved food processing characteristics or abilities. More specifically, it is an object of the present invention to provide electric ovens with enhanced characteristics for processing food items which are relatively thick, chunky or bulky. It is also an object of the present invention to overcome or, at least, alleviate shortcomings associated with conventional electric ovens.

More specifically, it is an object of the present invention to provide electric ovens with improved heating means so that food items of a larger size, such as whole chickens or ducks, can be cooked in a lesser time while retaining the desirable surface characteristics of food items cooked by conventional electric ovens. It is yet another object of the present invention to provide electric ovens which can also be reconfigured as a toasting apparatus with improved heating means. At a minimum, it is an object of the present invention to provide the public with a useful choice of a new electric oven.

SUMMARY OF THE INVENTION

In view of the above and according to the present invention, there is provided a food processing apparatus including a main housing, a heating compartment, first heating means and second heating means, said heating compartment being enclosed within said main housing, said first heating means being generally disposed proximal to the peripheral surface of said heating compartment for generating heat across said heating compartment for heating food or food items placed within said heating compartment, said second heating means generally extending from a peripheral surface of said heating compartment towards the inside of said heating compartment for generating heat towards the peripheral surfaces of said heating compartment.

According to another aspect of the present invention, there is provided a food processing apparatus including a main housing, a heating compartment and first heating means, said heating compartment being generally rectangular and including a first and a second reception windows disposed on adjacent sides of said heating compartment, said first heating means include a first and a second set of folded heating elements which are configurable in a first operating configuration and a second operating configuration such that, when in said first operating configuration, said first and second sets of folded heating elements being disposed so that said first and second sets of folded heating elements are respectively adjacent to said second reception window and the peripheral surface of said heating compartment opposite said second reception window and, when in said second operating configuration, said first and second sets of folded heating elements being disposed so that said first and second sets of folded heating elements being respectively adjacent to said first reception window and the peripheral wall opposite said first reception window.

Preferably, said first heating means include a length of folded heating element.

Preferably, said length of heating element being folded into multiple-U shapes.

Preferably, said length of heating elements being generally convoluted.

Preferably, said second heating means include a length of heating element extending from one peripheral wall of said heating compartment towards the opposite peripheral wall of said heating compartment.

Preferably, said length of heating element of said second heating means include a U-shaped heating portion with the curved bent portion approaching said opposite peripheral wall.

Preferably, said second heating means is collapsible from said extending configuration.

Preferably, said second heating means being collapsible from said extending position to a position in which said length of heating element of said second heating means being generally proximal to the peripheral surface of said heating compartment.

Preferably, said heating compartment being generally rectangular, said length of heating element of said second heating means in its first configuration extends generally from a first side wall of said heating compartment to the opposite side wall, said length of heating element of said second heating means being collapsible from said first configuration to a second configuration in which said length of heating element of said second heating means being proximal to said first side wall.

Preferably, said heating compartment being generally rectangular and including a first and a second reception windows disposed on adjacent sides of said heating compartment, said first heating means include a first and a second set of folded heating elements which are configurable in a first operating configuration and a second operating configuration such that, when in said first operating configuration, said first and second sets of folded heating elements being disposed so that said first and second sets of folded heating elements are respectively adjacent to said second reception window and the peripheral surface of said heating compartment opposite said second reception window, and, when in said second operating configuration, said first and second sets of folded heating elements being disposed so that said first and second sets of folded heating elements being respectively adjacent to said first reception window and the peripheral wall opposite said first reception window.

Preferably, the configurations of said first and said second set of folded heating elements are controllable via a lever system by a rotatable knob disposed on the outside of said main housing.

Preferably, a pair of guiding tracks are formed on the opposite sides of said heating compartment which are not proximal to said first or said second sets of folded heating elements of said first heating means when in either said first or said second configurations, said pair of guiding tracks are positioned to receive a shelf so that said first and second sets of folded heating elements are disposed respectively above and below said shelf when in said first configuration.

Preferably, when said apparatus is operating in said first operating configuration, said second heating means being erected so that it extends towards said first reception window.

BRIEF DESCRIPTION OF THE DRAWING

Preferred embodiments of the present invention will be explained in further detail below by way of examples and with reference to the accompanying drawings, in which.

DETAILED DESCRIPTION OF THE PREFERRED EMBODIMENTS

Figure 1:
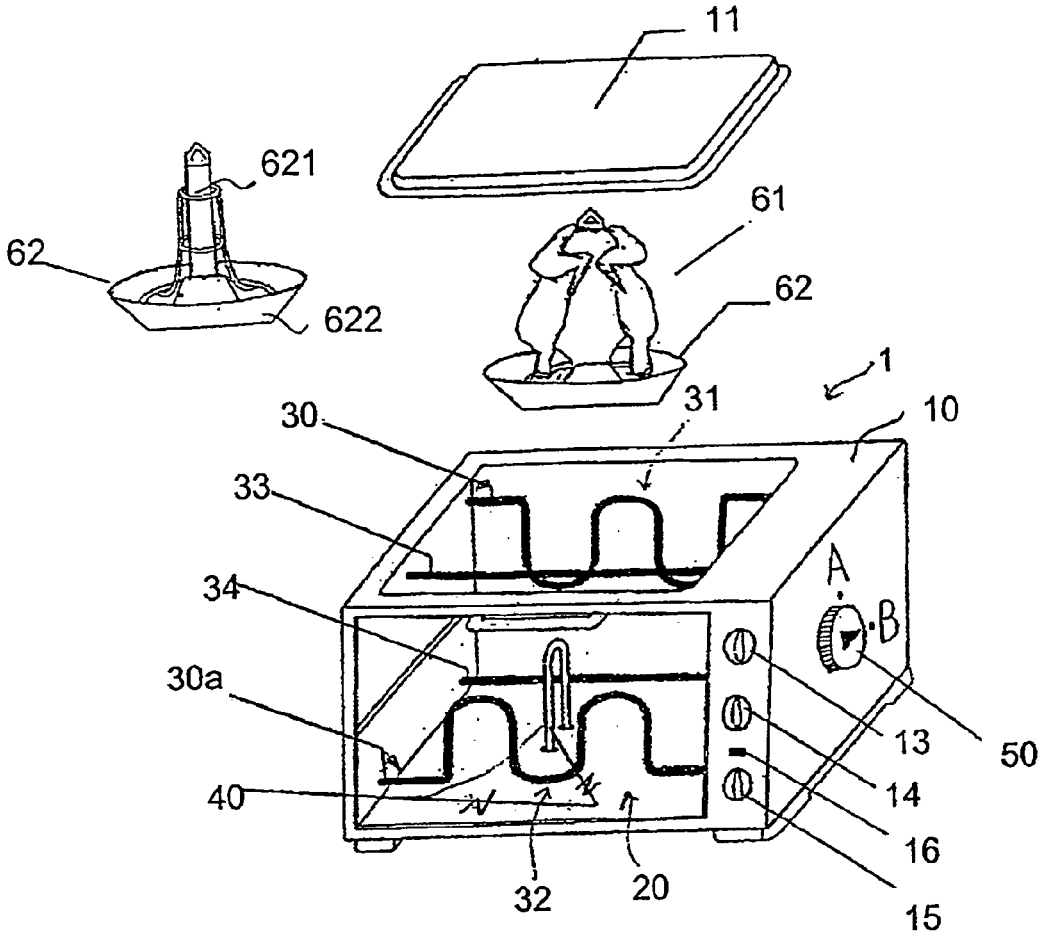
FIG. 1 is a perspective view showing a first preferred embodiment of a food processing apparatus in its first operating configuration, also being illustrated is a chicken being an example of a bulky food item, to be placed into the food cooking compartment for processing.

Referring to FIGS. 1 to 5, a food processing apparatus in the form of an electric oven 1 of a first preferred embodiment of the present invention is shown. The electric oven 1 includes a main housing 10 defining a cooking or heating compartment 20, first heating means 30, second heating means 40 and heater configuration means 50. In order to provide access to the heating compartment 20, a first reception window 11 is provided on the main housing 10. To provide added convenience and flexibility, a second reception window 12 may also be provided as an optional feature. Furthermore, a plurality of control means, including a temperature control knob 13, a mode select knob 14 and a timer 15 may be provided. Preferably, a visual indicator 16 is also provided on the main housing 10 to indicate the operating conditions of the apparatus 1.

The main housing 10 includes a plurality of rigid peripheral walls which, together, generally enclose the heating or cooking compartment 20. The peripheral walls preferably have a metallic surface and preferably also include an insulating liner to minimize heat escaping from the heating compartment 20 to the outside through the peripheral walls. To facilitate more convenient monitoring of the food processing conditions inside the heating compartment 20, some of the peripheral walls, for example, the reception window 11 or 12, are preferably made of glass or other heat resistant transparent materials.

The first heating means 30 are generally provided for heat generation across the heating compartment 30 in order to provide the required thermal energy for cooking or food processing within the heating compartment 20. Typically, the first heating means 30 includes heating elements disposed proximal to the periphery or boundary of the heating compartment 20 in order to maximize the available food processing space inside the heating compartment 20. The heating elements of the first heating means 30 are preferably distributed heating elements so that heat can be generated more evenly across the heating compartment 20. A distributed heating element includes, for example, a length of folded or bent heating elements in, for example, a convoluted form, a U- or a multi-U shape.

In the present preferred embodiment, the first heating means include a multi-U shaped heating element as a convenient example. More specifically, the multi-U heating elements are generally arranged so that the U-planes are substantially parallel to the most proximal peripheral surface of the heating compartment 20, although other arrangements are of course also possible without loss of generality.

To provide more even heating within the heating compartment, the first heating means 30 in the present preferred embodiment includes a first set 31 and a second set 32 of distributed heating elements which are disposed generally proximal to the opposite peripheral sides of the heating compartment 20. To provide more distributed heating within the heating compartment 20, additional heating elements, for example, elongated heating elements 33 and 34 may be distributed within the heating compartment in addition to the folded or distributed heating elements 31 and 32.

In order to enhance the processing of food items which are particularly bulky or chunky, especially food items with an internal cavity such as a whole chicken or a whole duck, a second heating means adapted to heat the food items from their inside is provided. In one perspective, this second heating means 40 is generally configured so that heat is generated from somewhere inside the heating compartment 20 towards the periphery of the heating compartment 20. In a more specific example as shown in the present preferred embodiment, this second heating means 40 includes a heating element generally extending from a peripheral surface of the heating compartment 20 towards the inside of the heating compartment 20 for generating heat from the inside of the heating compartment towards the peripheral surfaces of the heating compartment.

In the preferred specific embodiment, the second heating means 40 includes an inverted U-shaped heating element with the bifurcated arms of the heating element protruding from one peripheral side of the heating compartment 20. As shown in the Figure, the inverted U-bend is projected well inside the heating compartment 20 and extends towards the peripheral surface which is opposite to the base peripheral surface from which the second heating means 40 protrudes.

In order that the food item to be processed can be easily placed inside or removed from the heating compartment 20, a first reception window 11 is provided. The first reception window 11 in this preferred embodiment is a removable metal cover, preferably provided with a handle for easy attachment to or easy detachment from the main housing 10. In general, the first and the second heating means can include convection heating means such as resistive heating elements or radiant heating means such as infra-red heating elements or other appropriate heating elements. Of course, a combination of heating elements, including microwave heating, can be used without loss of generality.

Preferred operating modes and configurations of the present embodiment will be explained in further detail below.

Figure 2:
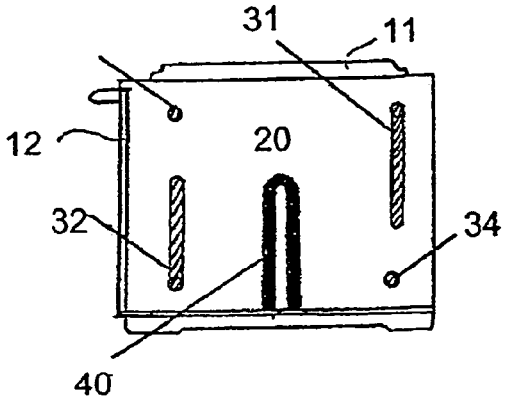
FIG. 2 is a cross-sectional view illustrating the application of the apparatus of FIG. 1 in its first operating configuration.
Figure 3:
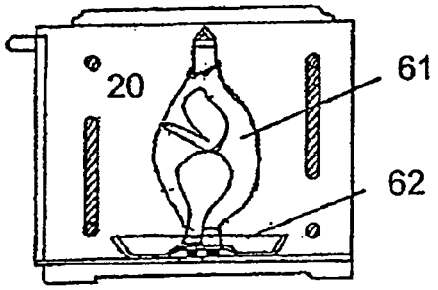
FIG. 3 shows the cross-sectional view of the apparatus of FIG. 1 with a chicken in the preferred disposition.

Referring firstly to FIGS. 1 to 3, the oven 1 is shown in its first operating configuration. While the main housing 10 and the heating compartment 20 of the oven 1 of the present embodiment is substantially rectangular as a convenient example for illustrating the invention, the main housing 10 and the heating compartment 20 can of course be formed into other appropriate shapes and configurations without loss of generality. Thus, in the present embodiment, the heating compartment and the main housing are substantially rectangular with the first reception window 11 disposed on the top surface, the second reception window 12 and the control interfacing means 13–15 disposed on the front surface. In addition, the heater configuration knob 50 is disposed on the left side of the main housing 10.

In this first operating configuration, the first set 31 and the second set 32 of the distributed or folded heating elements of the first heating means 30 are respectively disposed proximal to the back and front peripheral sides of the heating compartment 20. The optional or additional distributed elongated heating elements 33 and 34 are respectively disposed along the top front and lower back corners of the heating compartment in order to compensate for the remoteless of the corners from the first heating means. The second heating means 40 generally protrudes from the bottom peripheral surface of the heating compartment 20 and with the inverted U-bend preferably extending well into the inside of the heating compartment 20. Preferably, the second heating means 40 is generally disposed near the middle of the bottom peripheral surface so that food item of varying sizes to be heated by the second heating means can be accommodated within the heating compartment 20.

With the oven in this first operating configuration, the food item will be placed inside the heating compartment via the first reception window 11. To avoid direct heating, the food article 61, which is a whole chicken for the present example, is supported on a roast support 62 which includes an upwardly extending collar member 621 and a base portion 622. The roast support 62 is preferably highly thermal conductive so that heat generated by the second heating means 40 can be efficiently transmitted to the food article 61. The base portion 622 of the roast support 62 is preferably provided with fluid retention means so that fluids, such as meat juices or sauces, resulting from the heat processing of the food article 61 can be collected for easy disposal. In use, the upwardly extending collar member 621 of the roast support member is inserted into the inside, or cavity, of the food article 61 where appropriate and the roast support member 62 is then inserted onto the protruding second heating means 50. After the food article 61 has been duly placed within the heating compartment 20, the first reception window 11 is duly closed and the food can then be processed inside the heating compartment 20.

In order to process the food article 61, the oven can be set to pre-determined processing programmes or routines or simply by setting the various perimeters including time and temperature. For example, for cooking a whole chicken of a medium size, a temperature of 450° F. for 30 minutes may be feasible. Of course, the processing time and temperature would largely depend on the size and other characteristics of the food articles. To provide even more sophisticated food processing conditions within the heating compartment 20, the distributed folded elements 31 and 32 and the elongated heating elements 33 and 34 may be alternately turned on or off so that more even processing conditions can be provided. As a further option, the individually heating elements 31, 33, 32, 34 can be sequentially turned on and off so that the food item can be subject to cyclical or rotational heating to further provide a more sophisticated roast. Of course, the on- and off-timings and durations can be adjusted when necessary and according to personal preferences.

The oven 1 in this first operating configuration can be set into the toasting mode by collapsing the second heating means so that the plane of the U-shaped second heating member 50 is proximal and generally lies parallel to the bottom peripheral surface of the heating compartment. With the collapse of the second heating means 40, the space between the first set 31 and the second set 32 of the folded heating elements can be utilized as a toasting space or an ordinary baking space. The U-shaped heating element of the second heating means 40 can be collapsed, for example, by turning the heater configuration knob 50 which is connected to the second heating means 40 via a set of transmission link. The transmission link can, for example, be similar in principle to the transmission link to be described below.

Figure 4:
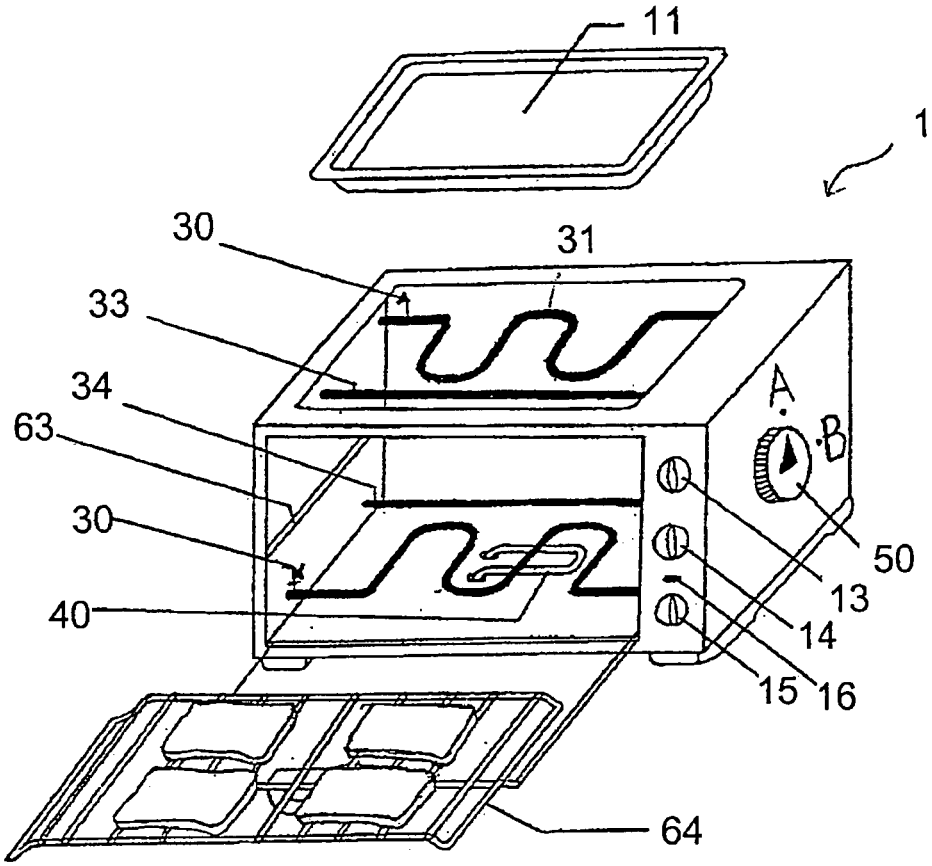
FIG. 4 is a perspective view showing the apparatus of FIG. 1 in its second operating configuration illustrating also a toasting shelf with pieces of bread as an example of food to be toasted
Figure 5:
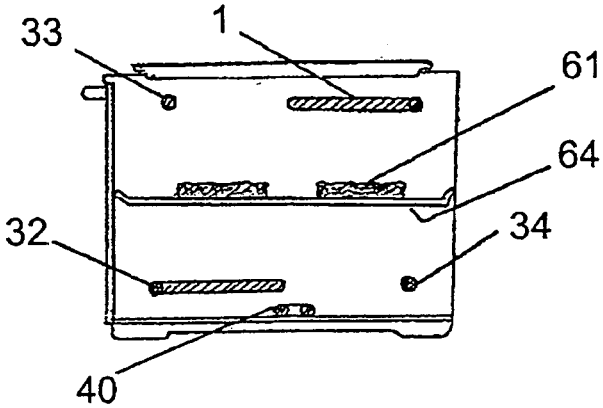
FIG. 5 is a cross-sectional view of the food processing apparatus of FIG. 3, showing in particular the relative dispositions of the heating elements in the second operating configuration.

Referring to FIGS. 4 and 5, the oven is in its second operating configuration. In the present preferred embodiment, a user can rotate the heater configuration means 50 anti-clockwisely to change the heating elements from the first operating condition to the second operating condition. An example of a suitable transmission link for effectuating the heater configurations will be explained in further detail below.

In this second operating configuration, the second heating means 50 is collapsed so that its U-plane is proximal to and lies substantially parallel to the bottom peripheral surface of the heating compartment 20. On the other hand, the first set 31 and the second set 32 of the folded or distributed heating elements of the first heating means are rotated about their respective supporting axles so that they are generally disposed proximal or adjacent respectively to the first reception window and the bottom peripheral surface of the heating compartment 20, that is, the peripheral wall opposite the first reception window 11. With the heaters in this second operating configuration, a food processing compartment is generally formed between the top and the bottom surfaces of the main housing or the heating compartment or, in other words, between the first set 31 and the second set 32 of the folded heating elements of the first heating means. Guiding tracks 63 are provided within the main housing and on the left and right sides of the housing for supporting a grilling or toasting shelf, which can be, for example, a grille or a tray for toasting the food article placed on the shelf by operating the heaters 31 and 32 above and/or below the shelf 63.

Figure 6:
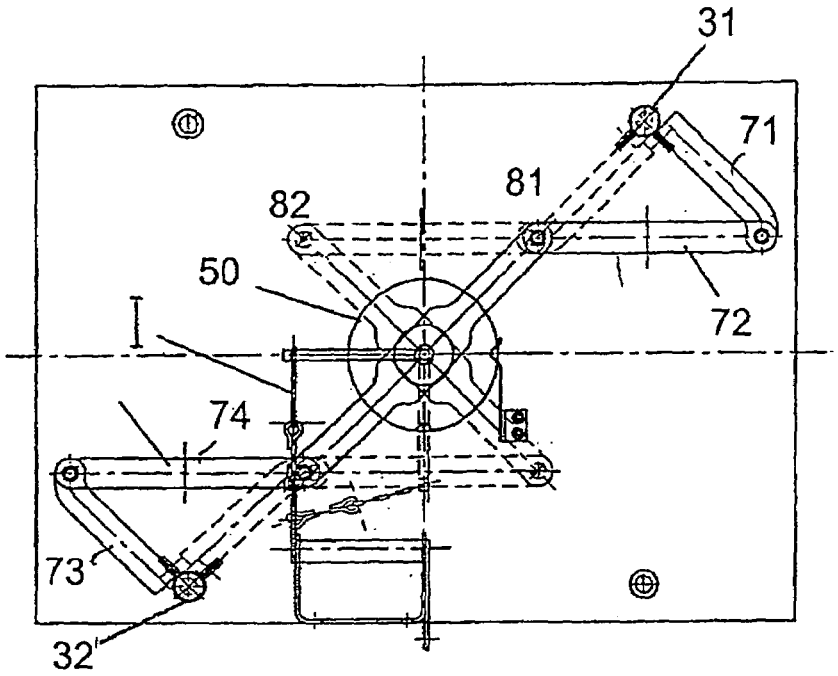
FIG. 6 illustrates an example transmission mechanism for controlling the configuration of the first heating means of the apparatus of FIG. 1.

An example transmission mechanism for reconfigurating the first heating means is shown in FIG. 6. Referring to FIG. 6, the heater configuration knob 50 is connected to the heating elements 31 and 32 respectively via a first and a second sets of transmission link. The first transmission link includes a first 71 and a second 72 arms which are hinged together. The non-hinged end of the arm 71 is connected to the heating element 31 while the corresponding end of the arm 72 is pivotally connected to the heater configuration knob 50. It will be noted that when the heater configuration knob 50 has been turned 90° anti-clockwisely, the pivoted end of the arm 72 will move from position 81 to position 82, thereby rotating the heater 31 by approximately 90°, corresponding to the required reconfiguration between the first operating configuration and the second operating configuration. Likewise, the second heating means 32 is connected to the heater configuration knob 50 via a first 73 and a second 74 hinged arm which are pivotally joined to the heater configuration knob 50 and the movements are substantially similar.

Figure 7:
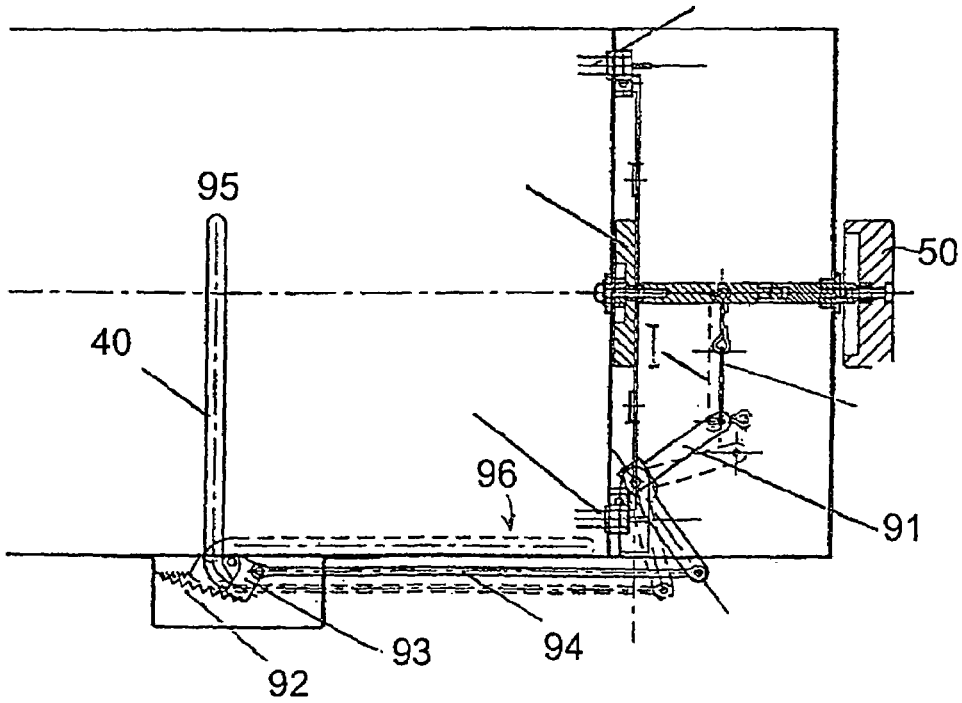
FIG. 7 illustrates an example transmission link for controlling the second heating means of the apparatus of FIG. 1.

A connection mechanism for erecting and collapsing the second heating means 40 is shown in FIG. 7. Referring to FIG. 7, the second heating means 40 is connected to the heater configuration knob 50 via a V-shaped arm 91. It will be noted from the Figure that the base of the second heating means 40 is connected to a tension spring 92 about a pivotal point 93. When the heater configuration knob 50 is rotated, the second heating means will be moved between the erected position 95 and the collapsed position 96 as a result of the translational movement of the connecting link 94 about the pivotal point 93. To ensure that the second heating means is disposed either in position 95 or in position 96, the tension spring 92 is adapted so that it will restore the second heating means to the collapsed position 96 unless obstructed, for example, by the roast support member 62.

It will be appreciated that the transmission links for the first and the second heating means can be dependently or independently connected without loss of generality.

Figure 8:
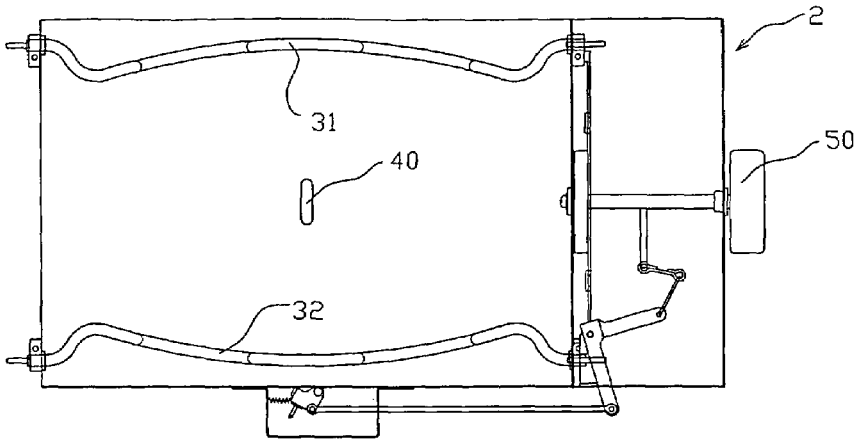
FIG. 8 shows a second preferred embodiment of the food processing apparatus of the present invention.
Figure 9:
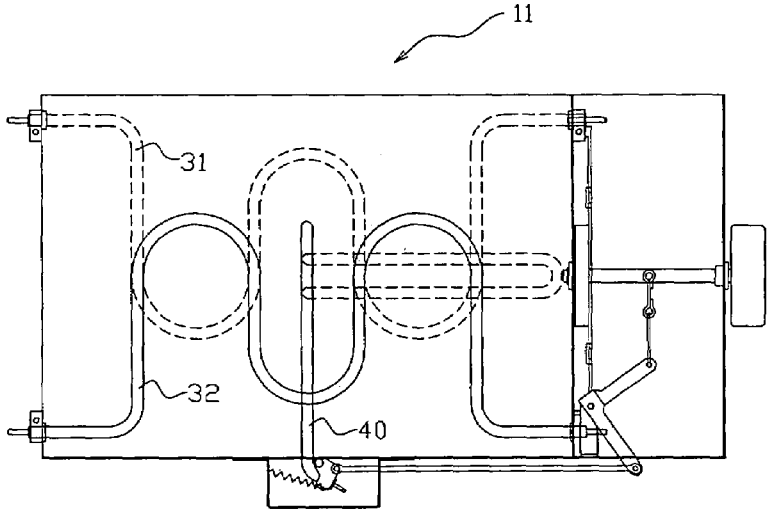
FIG. 9 illustrates the food processing apparatus of FIG. 8 when viewed from the above.
Figure 10:
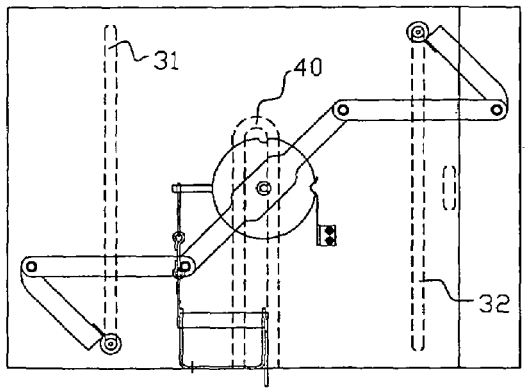
FIG. 10 illustrates in more detail an example transmission link for controlling the first heating means of FIG. 9.

A second preferred embodiment of an electric oven 2 of the present invention is shown in FIGS. 8–10. The oven 2 shown in FIGS. 8–10 is generally identical to that of the first preferred embodiment but with the second heating means protruding from the rear peripheral surface of the heating compartment 20 towards the front surface. Also, the first reception window 11 is now disposed on the front surface of the heating compartment so that user can access the heating compartment through the front surface of the heating compartment 20.

In this second preferred embodiment, the first set 31 and the second set 32 of the folded or distributed heating elements of the first heating means are proximally disposed respectively adjacent to the top and the bottom surfaces of the heating compartment 20 and the second heating means 40 generally projects into the inside of the heating compartment from about the middle of the rear surface of the heating compartment 20. When a bulky food item is to be processed, the food item can be inserted into the heating compartment 20 with the inside or cavity inserted onto the protruding part of the second heating means so that the food item can be heated from above, below and inside. Likewise, additional elongated heating elements can be provided along the remote corners of the heating compartments not readily or satisfactorily served by the distributed or folded heating elements 31 and 32. Likewise, the second heating means can be collapsed so that it can be off cut lies proximal to the rear surface of the heating compartment when it is no longer necessary or obstructed processing space or compartment is preferred. Similarly, the second heating means can be erected or collapsed by a transmission mechanism controllable by the heater configuration knob 50 in a manner similar to that described above.

In the present specification, common numerals have been used to designate parts which are common or identical for use in the various embodiments to the extent where the context permits and without loss of generality.

In a third preferred embodiment of the present invention, the electric oven is generally identical to that of the electric oven 1 of the first preferred embodiment as shown in FIG. 1 except that the second heating means 40 is not provided. Thus, the oven of this third preferred embodiment includes a main housing 10, a cooking or heating compartment 20 with a first reception window 11 and a second reception window, first heating means 30, heater configuration means 50 and a plurality of control and visual indicating means 13–16 as described above in connection with the first preferred embodiment.

Similarly, the first heating means includes a first set 31 and a second set 32 of distributed heated elements each of which are rotatable between a first operating configuration and a second configuration as in the case of the first preferred embodiment. The heater configuration is generally effectuated by the heater configuration means 50 via an appropriate transmission link similar to that described above without loss of generality. Thus, the oven of the third preferred embodiment includes a heating compartment 20 which are defined between the two sets of distributed heater elements 31 and 32. In the first operating configuration, the heaters are disposed proximal to the first reception window and the back peripheral surface of the heating compartment. In the second operating configuration, the heaters are disposed proximal to the second reception window (top surface) and the bottom peripheral surface of the heater compartment. With this arrangement, a more flexible food processing environment can be provided.

While the present invention has been explained by reference to the preferred embodiments described above, it will be appreciated that the embodiments are only examples provided to illustrate the present invention and are not meant to be restrictive on the scope and spirit of the present invention. In particular, the scope of ths invention should be determined from the general principles and spirit of the invention as described above. In particular, variations or modifications which are obvious or trivial to persons skilled in the art, as well as improvements made on the basis of the present invention, should be considered as falling within the scope and boundary of the present invention. Furthermore, while the present invention has been explained by reference to ovens with electric heating elements, it should be appreciated that the invention can apply, whether with or without modification, to other ovens utilizing also microwave heating.

What is claimed is:

1. A food processing apparatus including a main housing, a heating compartment, first heating means and second heating means, said heating compartment being enclosed within said main housing, said first heating means being generally disposed proximate to the peripheral surface of said heating compartment for generating heat across said heating compartment for heating food or food items placed within said heating compartment, said first heating means including a length of folded heating element, said second heating means generally extending from a peripheral surface of said heating compartment towards the inside of said heating compartment for generating heat towards the peripheral surfaces of said heating compartment, said second heating means including a length of heating element extending from one peripheral wall of said heating compartment towards the opposite peripheral wall of said heating compartment, wherein said second heating means is collapsible from an extending position.

2. The food processing apparatus of claim 1, wherein said first heating means include a length of folded heating element.

3. The food processing apparatus of claim 2, wherein said length of heating element is folded into multiple-U shapes.

4. The food processing apparatus of claim 1, wherein said length of heating element of said second heating means includes a U-shaped heating portion with the curved bent portion approaching said opposite peripheral wall.

5. The food processing apparatus of claim 1, wherein said second heating means is collapsible from said extending position to a position in which said length of heating element of said second heating means is generally proximate to the peripheral surface of said heating compartment.

6. The food processing apparatus of claim 5, wherein said heating compartment is generally rectangular, said length of heating element of said second heating means in a first configuration extends generally from a first side wall of said heating compartment to the opposite side wall, said length of heating element of said second heating means being collapsible from said first configuration to a second configuration in which said length of heating element of said second heating means is proximate to said first side wall.

7. The food processing apparatus of claim 1, wherein said length of heating element of said second heating means includes a U-shaped heating member.

8. The food processing apparatus of claim 7, wherein said second heating means is collapsible from said extending position.

9. The food processing apparatus of claim 8, wherein said second heating means is collapsible from said extending position to a position in which said length of heating element of said second heating means is generally proximate to the peripheral surface of said heating compartment from which said second heating means extends.

10. The food processing apparatus of claim 9, wherein said heating compartment is generally rectangular, said length of heating element of said second heating means in its first configuration extends generally from first side wall of said heating compartment to the opposite side wall, said length of heating element of said second heating means being collapsible from said first configuration to a second configuration in which said length of heating element of said second heating means is proximate to said first side wall.

11. The food processing apparatus of claim 7, wherein said heating compartment is generally rectangular and includes first and second reception windows disposed on adjacent sides of said heating compartment, said first heating means including a first and a second set of folded heating elements which are configurable in a first operating configuration and a second operating configuration such that, when in said first operating configuration, said first and second sets of folded heating elements being disposed so that said first and second sets of folded heating elements are respectively adjacent to said second reception window and the peripheral surface of said heating compartment opposite said second reception window, and, when in said second operating configuration, said first and second sets of folded heating elements being disposed so that said first and second sets of folded heating elements being respectively adjacent to said first reception window and the peripheral wall opposite said first reception window.

12. The food processing apparatus of claim 11, wherein the configurations of said first and said second set of folded heating elements are controllable via a lever system by a rotatable knob disposed on the outside of said main housing.

13. The food processing apparatus of claim 12, wherein a pair of guiding tracks are formed on the opposite sides of said heating compartment which are not proximate to said first or said second sets of folded heating elements of said first heating means when in either said first or said second configurations, said pair of guiding tracks are positioned to receive a shelf so that said first and second sets of folded heating elements are disposed respectively above and below said shelf when in said first configuration.

14. The food processing apparatus of claim 11, wherein when said apparatus is operating in said first operating configuration, said second heating means is erected so that it extends towards said first reception window.

15. A food processing apparatus including a main housing, a heating compartment and first heating means, said heating compartment being generally rectangular and including first and second reception windows disposed on adjacent sides of said heating compartment, said first heating means include a first and a second set of folded heating elements which are configurable in a first operating configuration and a second operating configuration such that, when in said first operating configuration, said first and second sets of folded heating elements being disposed so that said first and second sets of folded heating elements are respectively adjacent to said second reception window and the peripheral surface of said heating compartment opposite said second reception window and, when in said second operating configuration, said first and second sets of folded heating elements being disposed so that said first and second sets of folded heating elements being respectively adjacent to said first reception window and the peripheral wall opposite said first reception window.

16. A food processing apparatus including a main housing, a heating compartment, first heating means and second heating means, said heating compartment being enclosed within said main housing, said first heating means being generally disposed proximate to the peripheral surface of said heating compartment for generating heat across said heating compartment for heating food or food items placed within said heating compartment, said second heating means generally extending from a peripheral surface of said heating compartment towards the inside of said heating compartment for generating heat towards the peripheral surfaces of said heating compartment, said second heating means including a length of heating element extending from one peripheral wall of said heating compartment towards the opposite peripheral wall of said heating compartment, the length of heating element including a U-shaped heating member, wherein said second heating means is collapsible from an extending position.

17. A food processing apparatus including a main housing, a heating compartment, first heating means, and second heating means, said heating compartment being generally rectangular and including first and second reception windows disposed on adjacent sides of said heating compartment, said first heating means being generally disposed proximate to the peripheral surface of said heating compartment for generating heat across said heating compartment for heating food or food items placed within said heating compartment, said second heating means generally extending from a peripheral surface of said heating compartment towards the inside of said heating compartment for generating heat towards the peripheral surfaces of said heating compartment, said second heating means including a length of heating element extending from one peripheral wall of said heating compartment towards the opposite peripheral wall of said heating compartment, the length of heating element including a U-shaped heating member, said first heating means including a first and a second set of folded heating elements which are configurable in a first operating configuration and a second operating configuration such that, when in said first operating configuration, said first and second sets of folded heating elements being disposed so that said first and second sets of folded heating elements are respectively adjacent to said second reception window and the peripheral surface of said heating compartment opposite said second reception window and, when in said second operating configuration, said first and second sets of folded heating elements being disposed so that said first and second sets of folded heating elements being respectively adjacent to said first reception window and the peripheral wall opposite said first reception window.

* * * * *